US011122871B2

(12) United States Patent
Law

(10) Patent No.: US 11,122,871 B2
(45) Date of Patent: Sep. 21, 2021

(54) ARTICULATED CROSS PENDANT

(71) Applicant: Donna Law, Phoenix, AZ (US)

(72) Inventor: Donna Law, Phoenix, AZ (US)

( * ) Notice: Subject to any disclaimer, the term of this patent is extended or adjusted under 35 U.S.C. 154(b) by 55 days.

(21) Appl. No.: 16/719,472

(22) Filed: Dec. 18, 2019

(65) Prior Publication Data

US 2020/0187607 A1 Jun. 18, 2020

Related U.S. Application Data

(60) Provisional application No. 62/781,158, filed on Dec. 18, 2018.

(51) Int. Cl.
*A44C 25/00* (2006.01)

(52) U.S. Cl.
CPC ..... *A44C 25/005* (2013.01); *A44C 25/001* (2013.01)

(58) Field of Classification Search
CPC ... A44C 25/005; A44C 25/001; A44C 25/002; A44C 25/004
USPC ..... 63/12, 13, 21, 23; D11/79, 85, 96
See application file for complete search history.

(56) References Cited

U.S. PATENT DOCUMENTS

| | | | | |
|---|---|---|---|---|
| 770,573 | A * | 9/1904 | Hacherelle | A44C 25/001 63/23 |
| 1,032,257 | A * | 7/1912 | Walrow | A44C 25/001 63/23 |
| 1,052,980 | A * | 2/1913 | Smith | A44C 5/00 63/21 |
| 1,103,422 | A * | 7/1914 | Kluge | A44C 25/001 63/23 |
| 1,638,743 | A * | 8/1927 | Peterson | A44C 25/007 63/23 |
| 2013/0036768 | A1* | 2/2013 | Hernandez | A44C 25/005 63/23 |

* cited by examiner

*Primary Examiner* — Jack W Lavinder
(74) *Attorney, Agent, or Firm* — Schmeiser, Olsen & Watts LLP

(57) ABSTRACT

An articulated cross pendant, such as may be worn on a necklace around the neck of a user, is disclosed. The pendant has an upright bar crossed by a horizontal bar. The horizontal bar has right and left arms extending to the left and to the right of the upright bar, respectively. The upright bar may have an upper portion extending upward and a lower portion extending downward from the horizontal bar. The lower portion may be elongated such that it is longer than the upper portion and longer than each of the right and left arms of the horizontal bar. The top end of the upper portion may be looped, and the lower portion is fully articulated to prevent the ends of the upright bar, worn on a necklace, from poking or piercing the skin of a user when the user bows the head downward toward the chest.

12 Claims, 10 Drawing Sheets

ARTICULATED CROSS PENDANT

CROSS REFERENCE TO RELATED APPLICATION[S]

This application claims priority to U.S. Provisional Patent Application to Donna Law entitled "ARTICULATED CROSS PENDANT," Ser. No. 62/781,158, filed Dec. 18, 2018, the disclosures of which are hereby incorporated entirely herein by reference.

BACKGROUND OF THE INVENTION

Technical Field

This invention relates generally to jewelry and particularly to an articulated cross necklace pendant.

State of the Art

A cross necklace is any necklace featuring a Christian cross pendant or crucifix worn by Christians and others. The Christian cross, with or without a figure of Christ included, is the main religious symbol of much of Christianity. Conventional cross pendants are shaped as a cruciform having an upright bar traversed by a horizontal bar. The commonly worn Latin cross pendant features an elongated descending arm of the upright bar wherein the descending arm is longer than the ascending arm of the upright bar and longer than each of the arms of the horizontal bar.

A common problem with many cross pendants worn on a necklace, and particularly on a short necklace of about 18 inches or less, or of choker length, worn high on the chest near the crease of the neck or on the neck itself, is that the top and bottom ends of the upright bar tend to catch in the folds of skin or crease of the neck when the user bows the head downward toward the chest, thereby poking the top and bottom ends of the cross into the skin of the upper chest or neck. This can be painful for the user, and, in some cases, risks piercing the skin.

Accordingly, what is needed is an improved cross pendant that articulates and particularly may be worn on a necklace high on the chest near the crease of the neck or on the neck itself that does not catch in the folds of skin or crease of the neck when the user bows the head downward toward the chest.

SUMMARY OF THE INVENTION

The present invention relates to jewelry and particularly to an articulated cross necklace pendant.

An articulated cross necklace pendant comprises an upright bar traversed by a horizontal bar configured to hang by a chain or cord necklace worn around the neck of a user. The horizontal bar comprises opposed left and right arms extending to the left and to the right of the upright bar, respectively. The upright bar comprises an upper portion extending upward from the horizontal bar and a lower portion extending downward from the horizontal bar. The lower portion may be elongated such that the lower portion is longer than the upper portion and longer than each of the left and right arms of the horizontal bar.

In embodiments of the present invention, the upper portion of the upright bar and each of the left and right arms of the horizontal bar are solid, while the lower portion of the upright bar is articulated. As such, the articulated cross pendant generally maintains the shape of a cross while the user's head is raised up, but the lower portion flexes when the user bows the head downward toward the chest, thereby preventing the lower end thereof from poking or piercing the skin of the user.

In an embodiment, the top end of the upper portion is looped, such that the necklace may pass through the loop thereof wherein the articulated cross pendant hangs from the necklace while worn around the neck of a user. The looped top end also works in conjunction with the articulated lower portion to prevent the top end of the upper portion from poking or piercing the skin of the user when the user bows the head downward toward the chest.

Other embodiments may comprise any of the following components or features or any combination thereof that is consistent with the intended use and functionality of an articulated cross pendant: an attachment ring coupled to the top end of the upper portion, with a bail coupled thereto for hanging from a necklace; an inverted cross, wherein the lower end of the lower portion is looped for hanging from a necklace; a pair of attachment rings coupled to the left and right arms, respectively, wherein first and second ends of a necklace are coupled thereto for hanging the pendant from the necklace; an articulated upper portion having a bail attached to the top end thereof for hanging from a necklace; an articulated cross pendant with no upper portion, having a pair of attachment rings coupled to the left and right arms, respectively, wherein first and second ends of a necklace are coupled thereto for hanging the pendant from the necklace; and an articulated cross pendant with no upper portion, having one of an attachment ring, a loop, or a bail, coupled to the horizontal bar for hanging the pendant from a necklace.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in conjunction with the Figures, wherein like reference numbers refer to similar items throughout the Figures, and:

DETAILED DESCRIPTION OF EMBODIMENTS OF THE INVENTION

As discussed above, embodiments of the present invention relate to jewelry and particularly to an articulated cross necklace pendant.

Figure 1:
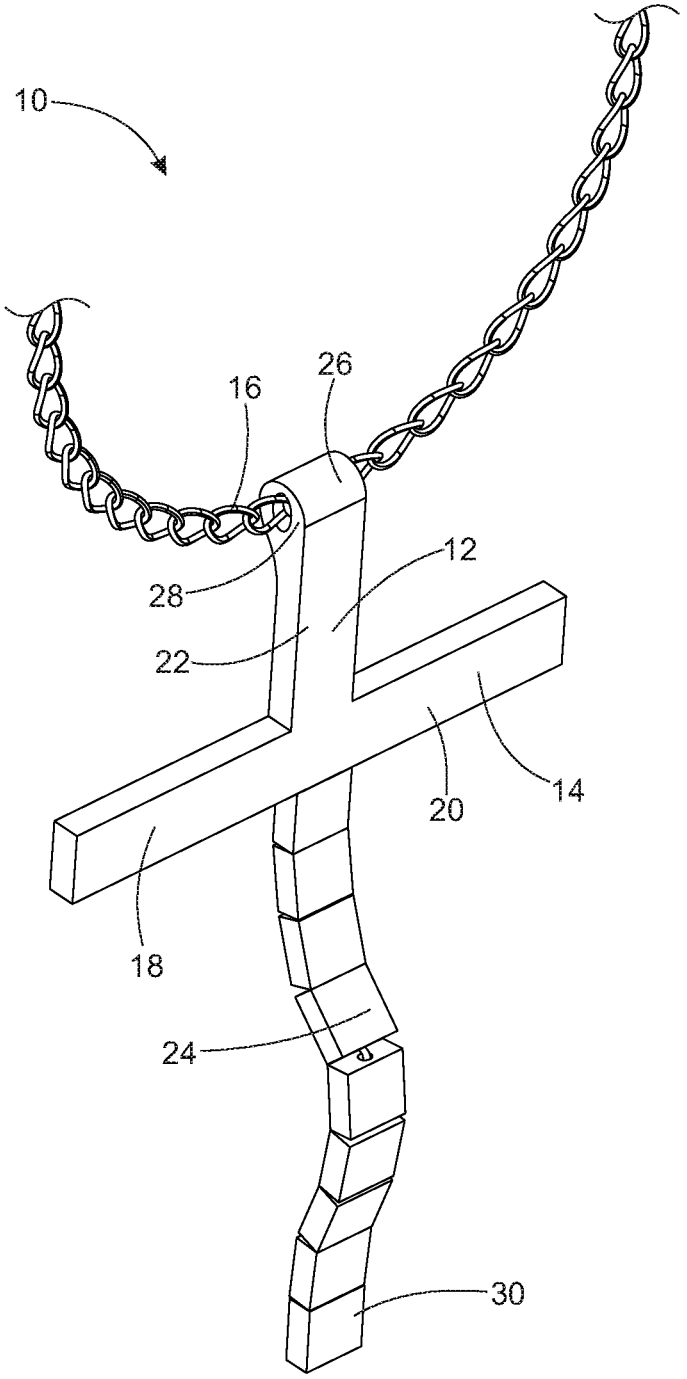
FIG. 1 is a perspective view of an articulated cross pendant in accordance with an embodiment.
Figure 2:
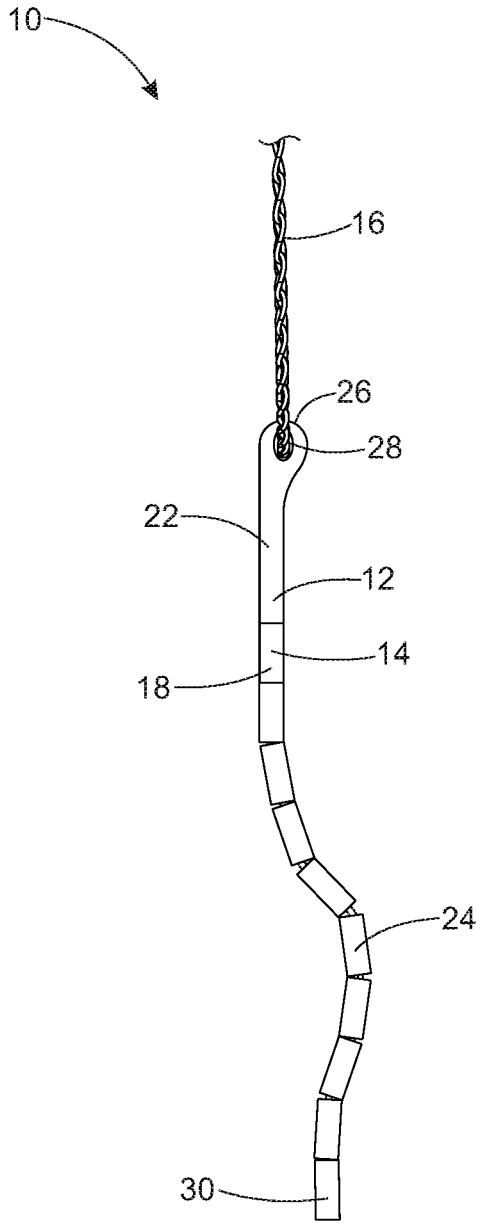
FIG. 2 is a side view of an articulated cross pendant in accordance with an embodiment.

Referring to the drawings, FIGS. 1 and 2 illustrate an articulated cross necklace pendant 10 comprising an upright bar 12 traversed by a horizontal bar 14 configured to hang by a chain or cord necklace 16 worn around the neck of a user. The horizontal bar 14 comprises opposed left and right arms, 18 and 20, extending in opposed directions orthogonal to the upright bar 12, respectively. The upright bar 12 comprises an upper portion 22 extending upward from the horizontal bar 14 and a lower portion 24 extending downward from the horizontal bar 14. The lower portion 24 may be elongated such that the lower portion 24 is longer than the upper portion 22 and longer than each of the left and right arms, 18 and 20, of the horizontal bar 14.

In some embodiments of the present invention, the articulated cross pendant 10 may be hung by a necklace 16 that is less than approximately 18 inches in length, such that the articulated cross pendant 10 is disposed in contact with the upper chest or neck of a user, when worn by the user.

For purposes of this Application, and as used in this Application, the phrase "fully articulated" shall mean comprising at least three jointed segments along the length thereof. FIG. 1 illustrates a representative non-limiting example of a fully articulated lower portion 24 of an upright bar 12 of an articulated cross pendant 10.

In some embodiments of the present invention, the upper portion 22 of the upright bar 12 and each of the left and right arms, 18 and 20, of the horizontal bar 14 are solid, while the lower portion 24 of the upright bar 12 is fully articulated. As such, the articulated cross pendant 10 generally maintains the shape of a cross while the user's head is raised up, but the lower portion 24 flexes when the user bows the head downward toward the chest, in response to contact with corresponding surfaces of the chin, neck, and/or chest of the user, thereby preventing the lower end 30 thereof from poking or piercing the skin of the user.

In an embodiment, the top end 26 of the upper portion 22 is looped, as shown in FIG. 2, such that the necklace 16 may pass through the loop 28 thereof from right to left, or from left to right, wherein the articulated cross pendant 10 hangs from the necklace 16 while worn around the neck of a user. The looped top end 26 also works in conjunction with the articulated lower portion 24 to prevent the top end 26 of the upper portion 22 from poking or piercing the skin of the user when the user bows the head downward toward the chest.

FIGS. 3A-H, are diagrammatic views of alternative embodiments of the invention.

Figure 3A:
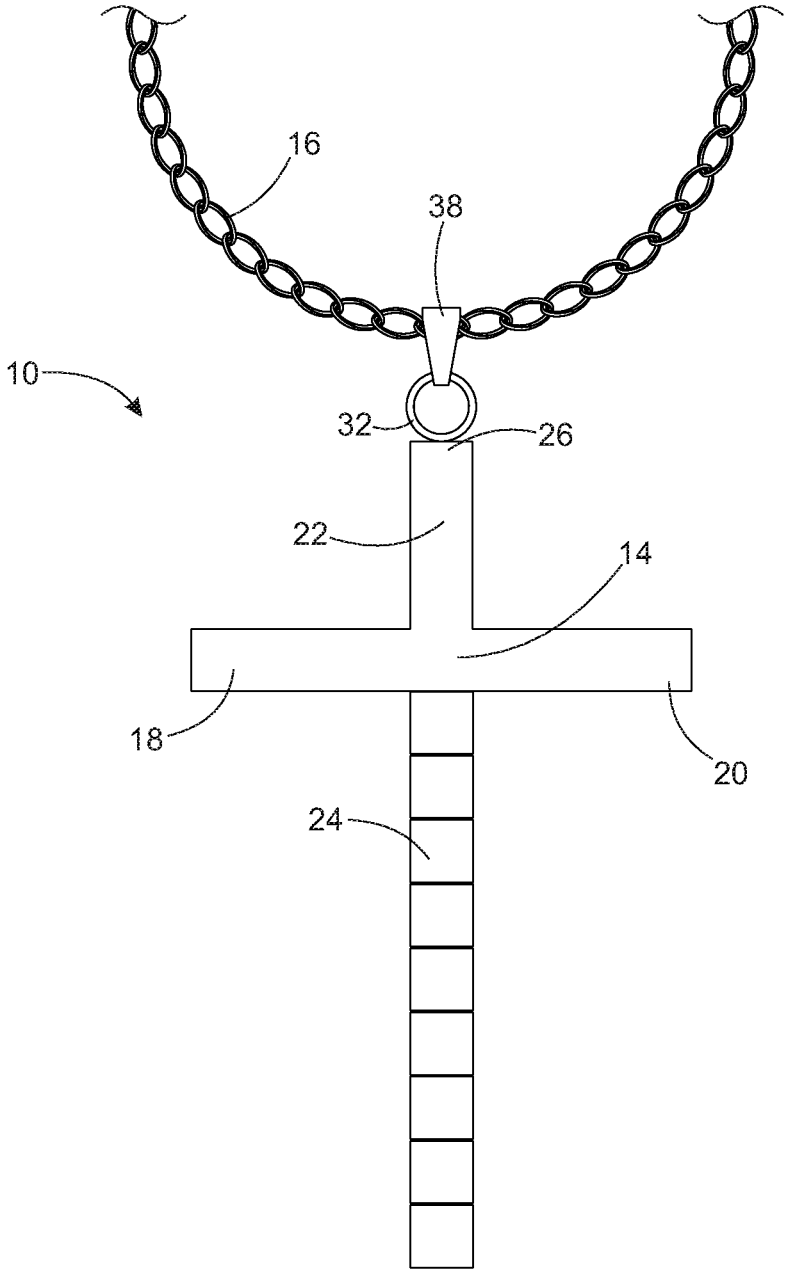
FIG. 3A is a front view of an articulated cross pendant in accordance with an embodiment.

In the embodiment shown in FIG. 3A, the top end 26 of the upper portion 22 comprises an attachment ring 32 fixedly coupled thereto, and a bail 38 hingedly coupled to the attachment ring 32, wherein the necklace 16 extends through an aperture in the bail 38 such that the articulated cross pendant 10 hangs from the necklace 16.

Figure 3B:
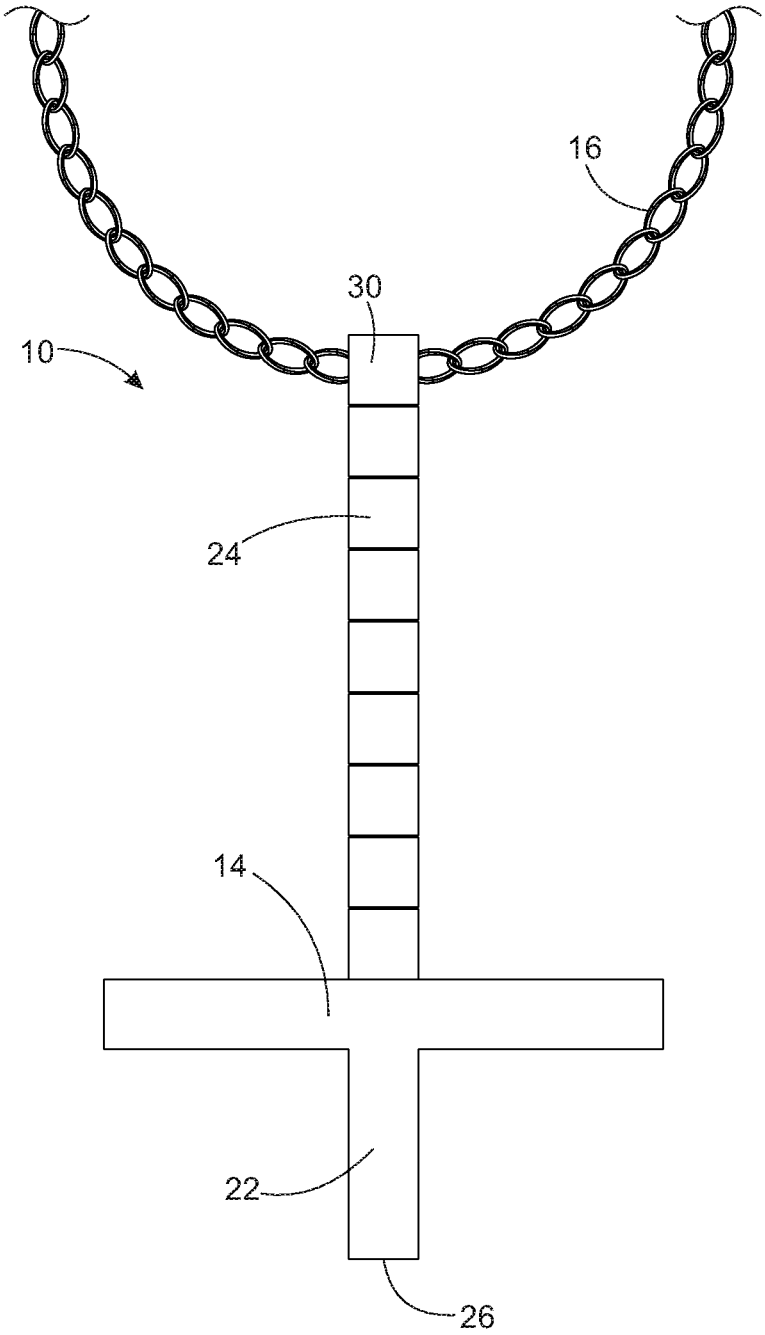
FIG. 3B is a front view of an articulated cross pendant in accordance with an embodiment.

In the embodiment shown in FIG. 3B, the articulated cross pendant 10 is inverted, such that the upright portion 22 extends downward and the lower portion 24 extends upward from the horizontal bar 14. In this embodiment, the lower end 30 of the lower portion 24 is looped for hanging the articulated cross pendant 10 from a necklace 16.

Figure 3C:
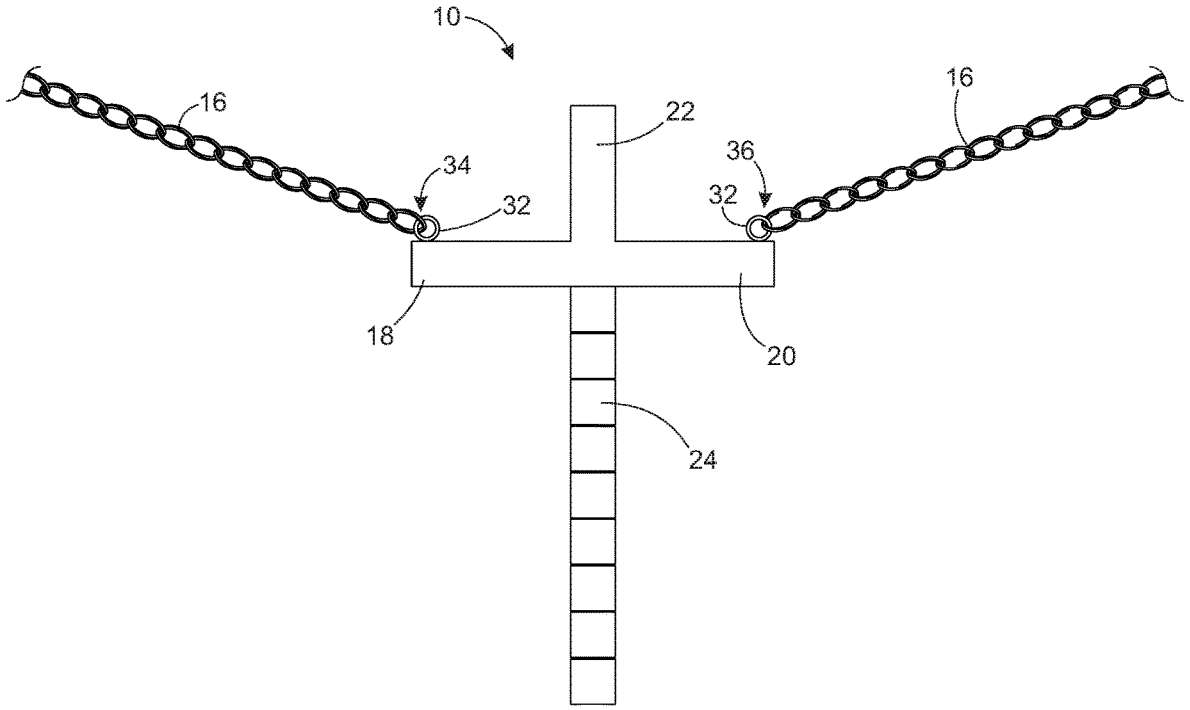
FIG. 3C is a front view of an articulated cross pendant in accordance with an embodiment.

In the embodiment shown in FIG. 3C, the articulated cross pendant 10 comprises a pair of attachment rings 32, each of the pair of attachment rings 32 being coupled to the left arm 18 and the right arm 20, respectively. The necklace 16 of this embodiment has first and second ends, 34 and 36, respectively, that are coupled to the respective attachment rings 32 for supporting the articulated cross pendant 10. In such a configuration the left and right arms, 18 and 20, respectively could be fully articulated (not shown).

Figure 3D:
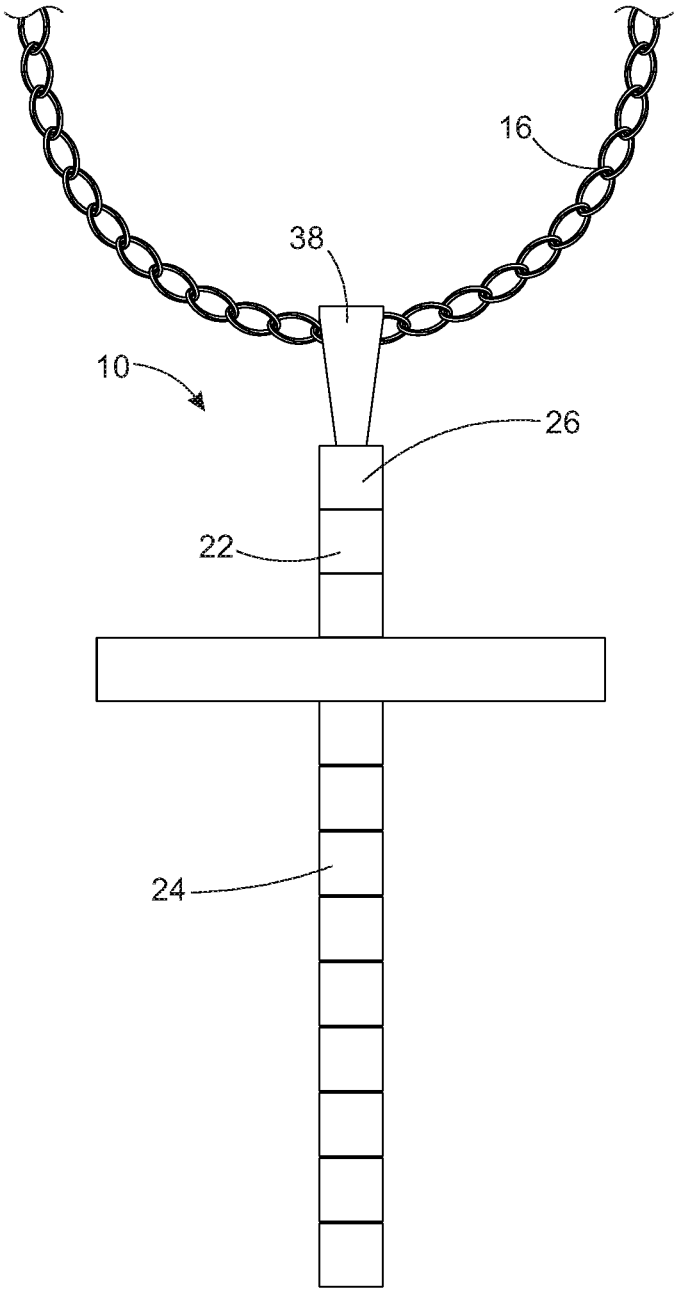
FIG. 3D is a front view of an articulated cross pendant in accordance with an embodiment.

In the embodiment shown in FIG. 3D, the articulated cross pendant 10 comprises a bail 38 coupled to the top end 26 of the upper portion 22. In addition, the upper portion 22 is fully articulated, rather than solid. The fully articulated upper portion 22 flexes when a user bows the head, in similar fashion to the fully articulated lower portion 30. The bail 38 is configured for hanging from a necklace 16 that extends through an aperture in the bail 38.

Figure 3E:
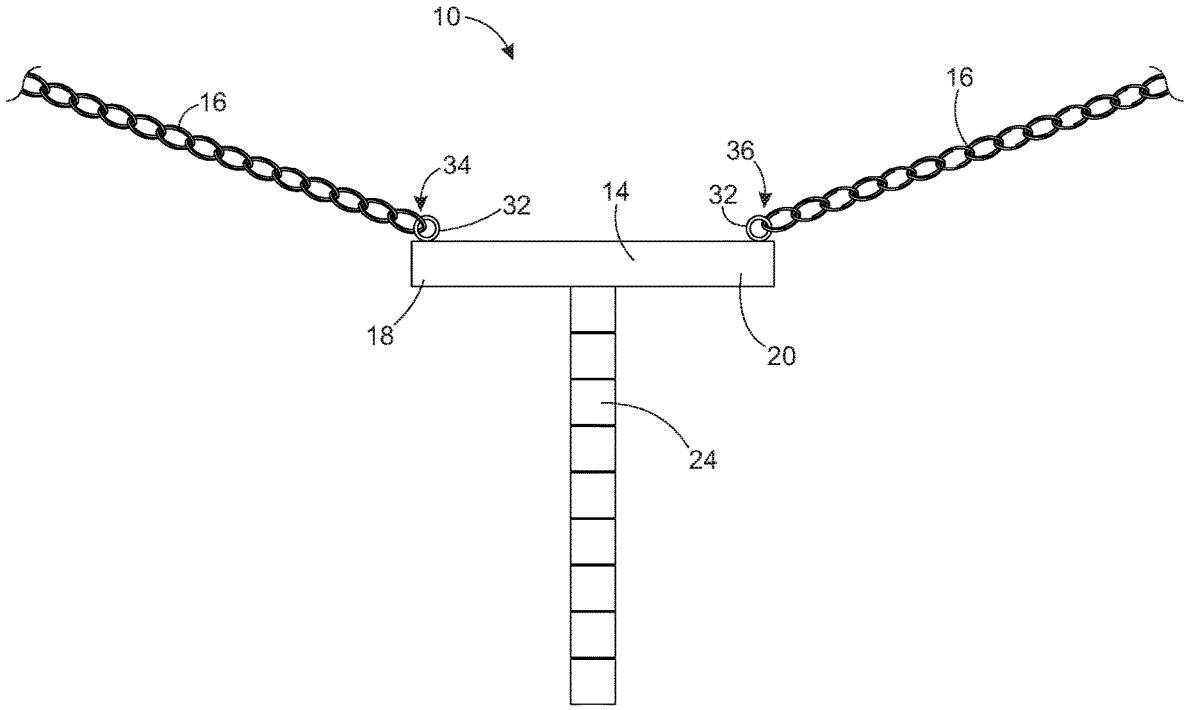
FIG. 3E is a front view of an articulated cross pendant in accordance with an embodiment.

In the embodiment shown in FIG. 3E, the articulated cross pendant 10 does not comprise an upper portion 22. This embodiment is otherwise similar to that shown in FIG. 3C.

Figure 3F:
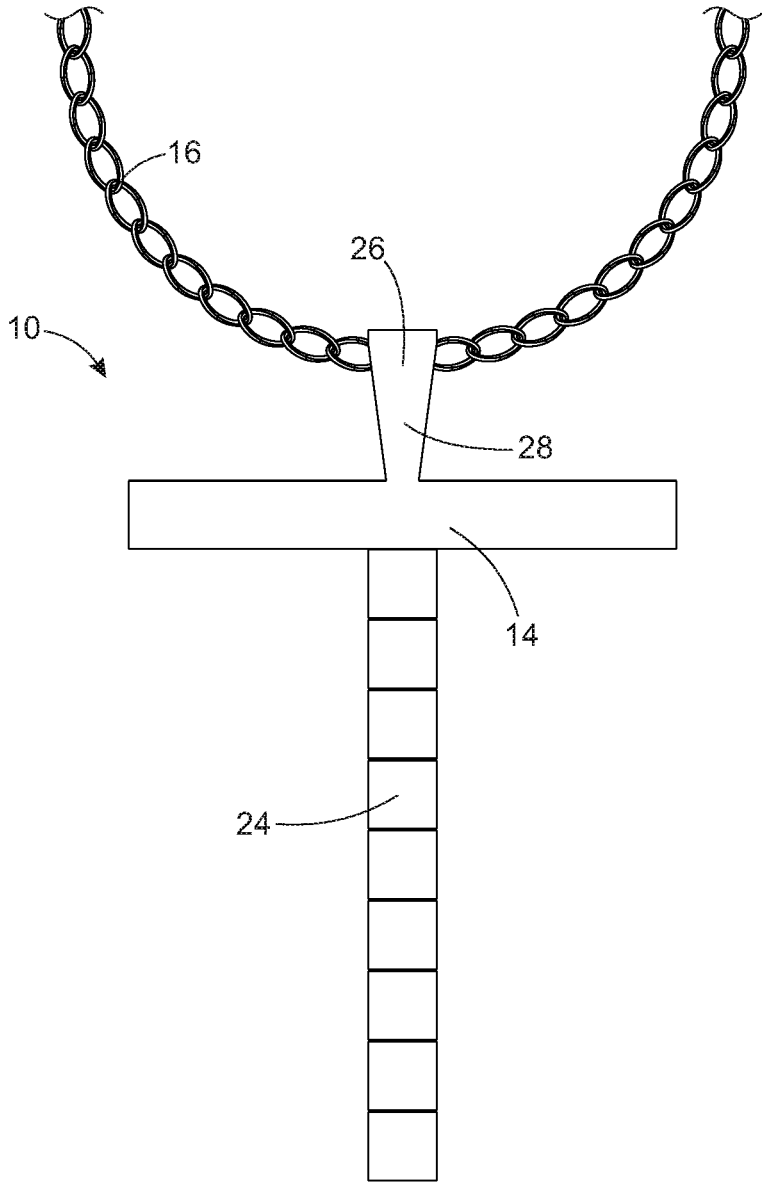
FIG. 3F is a front view of an articulated cross pendant in accordance with an embodiment.

In the embodiment shown in FIG. 3F, the articulated cross pendant 10 does not comprise an upper portion 22. This embodiment may comprise a loop 28, or an attachment ring 32 (not shown), or a bail 38 (not shown), coupled to the center of the horizontal bar 14 and configured for hanging from a necklace 16 that extends therethrough.

Figure 3G:
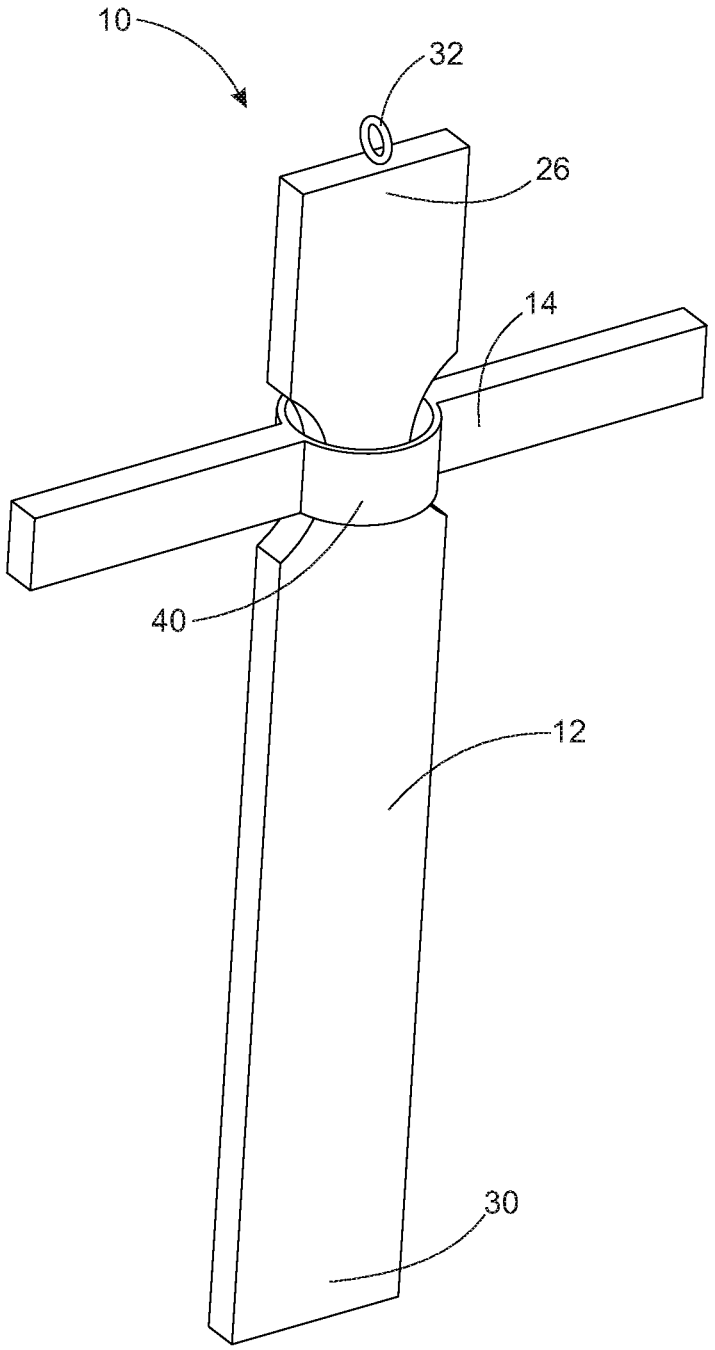
FIG. 3G is a front view of an articulated cross pendant in accordance with an embodiment.

In the embodiment shown in FIG. 3G, the horizontal bar 14 comprises a swivel 40, whereby the horizontal bar 14 is configured to swivel about the upright bar 12. The lower portion 12 may be solid, as shown, or it may be fully articulated, as in FIG. 1. In the solid configuration, as shown, articulated cross pendant 10 may not have the same functional advantage as other configurations of preventing the lower end 30 thereof from poking or piercing the skin of the user when the user bows the head downward toward the chest. However, whether in the fully articulated configuration or the solid configuration, the swiveled configuration, as shown in FIG. 3G, prevents a necklace 16, from which articulated cross pendant 10 hangs, from becoming entangled by twisting. This is because the horizontal bar 14 is able to remain in position as the upright bar 12 rotates with any twisting of necklace 16 from which it is configured to hang.

Figure 3H:
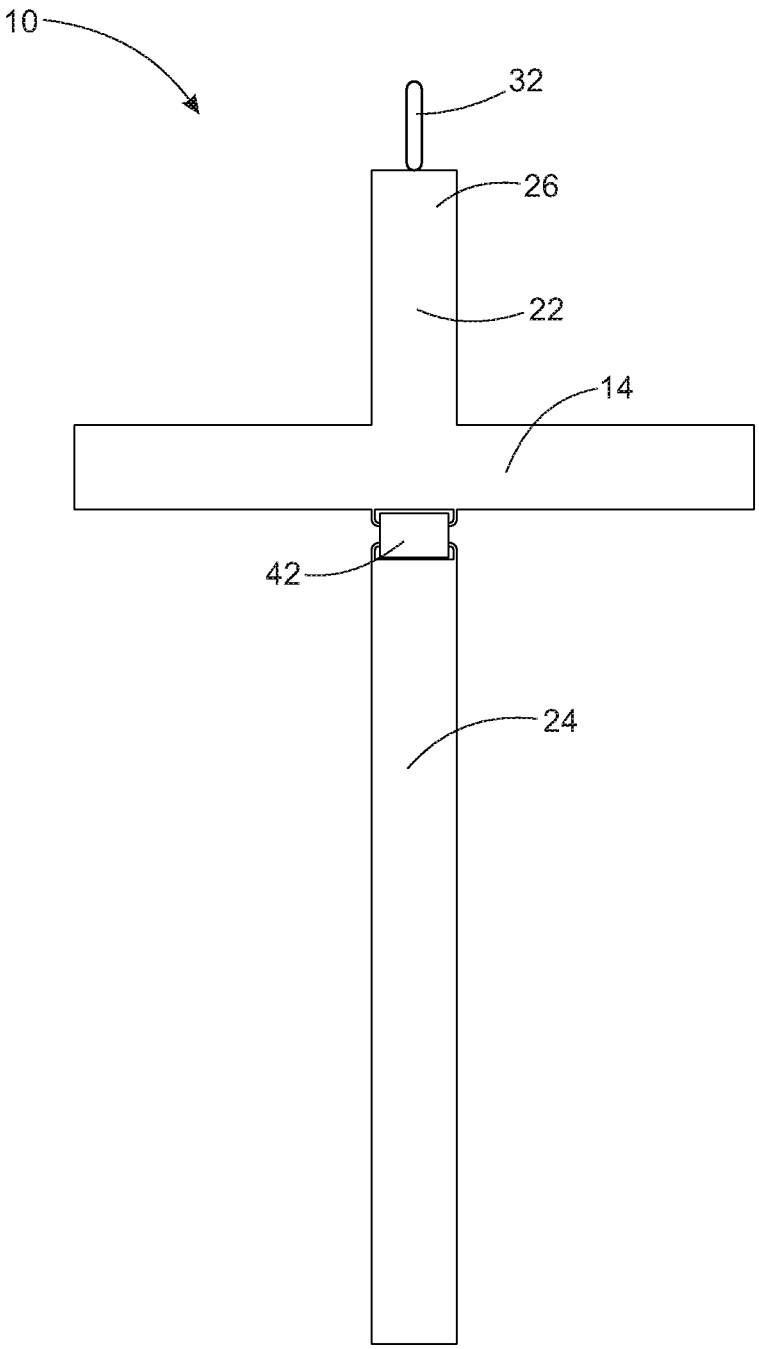
FIG. 3H is a front view of an articulated cross pendant in accordance with an embodiment.

In the embodiment shown in FIG. 3H, the entire lower portion 24 is not fully articulated, but articulated cross pendant 10 comprises a single hinge 42 by which the lower portion 24 is hingedly coupled to the horizontal bar 14.

In some embodiments, an articulated cross pendant 10 may further comprise at least one fish hook (not shown) coupled to the articulated cross pendant 10.

The various configurations of embodiments of the present invention, described above, are not intended to be limiting. It should be understood that embodiments may comprise any combination of the components or features thereof, as described, provided that such combination is consistent with the intended use and functionality of an articulated cross pendant, as described herein.

Embodiments of the present invention may comprise any of a variety of jewels, such as precious or semi-precious stones, or otherwise, attached to any component of an articulated cross pendant 10, by any means known by a person of ordinary skill in the art, now or in the future. Furthermore, embodiments of the present invention may comprise any of a variety of designs incorporated onto or into any component of an articulated cross pendant 10, such as by coloring, etching, piercing, shaping, molding, or otherwise, by any means known by a person of ordinary skill in the art, now or in the future, so long as such incorporation of designs is consistent with the intended functionality of an articulated cross pendant 10, as described above, wherein the articulated cross pendant 10 may have a solid upper portion 22, solid left and right arms, 18 and 20, a horizontal bar 14 that swivels about the upright bar 12, a hinged lower portion 24, and/or a fully articulated lower portion 24.

The components defining any articulated cross pendant 10 may be formed of any of many different types of materials or combinations thereof that can readily be formed into shaped objects provided that the components selected are consistent with the intended operation of an articulated cross pendant 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as gold, silver, copper, zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; precious stones, such as diamond, ruby, sapphire, emerald, any combination thereof, and/or other like materials; semi-precious stones, non-precious stones, any combination thereof, and/or other like materials; any other suitable material; and/or any combination thereof.

Furthermore, the components defining any articulated cross pendant 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, sewing, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A cross pendant, comprising:
a first bar; comprising:
a first portion; and
a second portion;
a second bar coupled perpendicular to the first bar to form a cross shape, the second bar further comprising:
a first arm; and
a second arm, wherein the first arm and the second arm extend in opposed directions, respectively, orthogonal to the first bar, and wherein the first portion and the second portion extend in opposed directions, respectively, orthogonal to the second bar;
wherein the second bar is solid, and each of the first portion and the second portion is fully articulated;
at least one articulating joint integral to at least one of the first bar or the second bar; and
wherein the second portion is longer in length than each of the first portion, the first arm, and the second arm, respectively.

2. The cross pendant of claim 1, wherein each of the second bar and the first portion is solid and the second portion is fully articulated.

3. The cross pendant of claim 1, wherein the second portion comprises a single hinge by which the second portion is hingedly coupled to the second bar.

4. A cross pendant assembly, comprising:
a necklace configured to be worn around the neck of a user;
a first bar; comprising:
a first portion; and
a second portion;
a second bar coupled perpendicular to the first bar to form a cross shape, the second bar further comprising:
a first arm; and
a second arm, wherein the first arm and the second arm extend in opposed directions, respectively, orthogonal to the first bar, and wherein the first portion and the second portion extend in opposed directions, respectively, orthogonal to the second bar;
wherein the second bar is solid, and each of the first portion and the second portion is fully articulated; and
at least one articulating joint integral to at least one of the first bar or the second bar.

5. The cross pendant assembly of claim 4, wherein each of the second bar and the first portion is solid and the second portion is fully articulated.

6. The cross pendant assembly of claim 5, wherein the necklace is a choker-style necklace having a length of 18 inches or less.

7. The cross pendant assembly of claim 4, wherein the second portion comprises a single hinge by which the second portion is hingedly coupled to the second bar.

8. The cross pendant assembly of claim 4, wherein the first portion is looped, wherein the necklace extends through a loop of the first portion.

9. The cross pendant assembly of claim 4, further comprising an attachment ring coupled to the first portion, wherein the necklace extends through the attachment ring.

10. The cross pendant assembly of claim 4, further comprising:
an attachment ring coupled to the first portion; and
a bail coupled to the attachment ring, wherein the necklace extends through the bail.

11. The cross pendant assembly of claim 4, further comprising a bail coupled to the first portion, wherein the necklace extends through the bail.

12. The cross pendant assembly of claim 4, further comprising:

a first attachment ring coupled between the necklace and the first arm; and a second attachment ring coupled between the necklace and the second arm.

* * * * *